US008602129B2

(12) United States Patent
Lockwood et al.

(10) Patent No.: US 8,602,129 B2
(45) Date of Patent: Dec. 10, 2013

(54) MATRIX BODY FIXED CUTTER BITS

(75) Inventors: Gregory T Lockwood, Pearland, TX (US); Youhe Zhang, Spring, TX (US)

(73) Assignee: Smith International, Inc., Houston, TX (US)

( * ) Notice: Subject to any disclaimer, the term of this patent is extended or adjusted under 35 U.S.C. 154(b) by 600 days.

(21) Appl. No.: 12/708,115

(22) Filed: Feb. 18, 2010

(65) Prior Publication Data

US 2010/0206640 A1 Aug. 19, 2010

Related U.S. Application Data

(60) Provisional application No. 61/153,590, filed on Feb. 18, 2009.

(51) Int. Cl.
*E21B 10/46* (2006.01)

(52) U.S. Cl.
USPC ..... 175/425

(58) Field of Classification Search
USPC ..... 175/425
See application file for complete search history.

(56) References Cited

U.S. PATENT DOCUMENTS

| | | | | |
|---|---|---|---|---|
| 3,379,503 | A | 4/1968 | McKenna | |
| 4,723,996 | A | 2/1988 | Brunet et al. | |
| 4,834,963 | A | 5/1989 | Terry et al. | |
| 5,089,182 | A | 2/1992 | Findelsen et al. | |
| 5,541,006 | A | 7/1996 | Conley | |
| 6,287,360 | B1 | 9/2001 | Kembaiyan et al. | |
| 6,454,028 | B1 | 9/2002 | Evans | |
| 6,908,688 | B1 | 6/2005 | Majagi et al. | |
| 7,475,743 | B2 | 1/2009 | Liang | |
| 7,541,090 | B2 | 6/2009 | Gerk et al. | |
| 2005/0211475 | A1 | 9/2005 | Mirchandani et al. | |
| 2005/0247491 | A1* | 11/2005 | Mirchandani et al. | 175/374 |
| 2006/0032335 | A1 | 2/2006 | Kembaiyan | |
| 2007/0079905 | A1* | 4/2007 | Gerk | 148/237 |
| 2008/0128951 | A1 | 6/2008 | Lockwood | |
| 2009/0260893 | A1 | 10/2009 | Sheng et al. | |
| 2010/0108399 | A1* | 5/2010 | Eason et al. | 175/425 |

OTHER PUBLICATIONS

International Search Report and Written Opinion of the International Search Authority dated Jun. 16, 2010 for corresponding application No. PCT/US2010/024561 filed Feb. 18, 2010.

* cited by examiner

*Primary Examiner* — Giovanna Wright

(57) ABSTRACT

A drill bit that includes a bit body having a plurality of blades extending radially therefrom, at least a portion of the plurality of blades comprises a first matrix region comprising a plurality of first carbide particles separated by a first binder phase, each of the first carbide particles comprising a mixture of WC and $W_2C$, and wherein the first matrix region has less than about 5 percent by volume, based on the total volume of the first matrix region, of complex metal carbides dispersed in the first binder phase; and at least one cutting element for engaging a formation disposed on at least one of the plurality of blades.

20 Claims, 5 Drawing Sheets

MATRIX BODY FIXED CUTTER BITS

CROSS-REFERENCE TO RELATED APPLICATIONS

This application claims priority to U.S. Provisional Application No. 61/153,590, filed Feb. 18, 2009, which is hereby incorporated by reference in its entirety.

BACKGROUND OF INVENTION

1. Field of the Invention

Embodiments disclosed herein relate generally to a composition for the matrix body of rock bits and other cutting or drilling tools.

2. Background Art

Polycrystalline diamond compact ("PDC") cutters are known in the art for use in earth-boring drill bits. Typically, bits using PDC cutters include an integral bit body which may be made of steel or fabricated from a hard matrix material such as tungsten carbide (WC). A plurality of PDC cutters are mounted along the exterior face of the bit body in extensions of the bit body called "blades." Each PDC cutter has a portion which typically is brazed in a recess or pocket formed in the blade on the exterior face of the bit body.

The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

While steel body bits may have toughness and ductility properties which make them resistant to cracking and failure due to impact forces generated during drilling, steel is more susceptible to erosive wear caused by high-velocity drilling fluids and formation fluids which carry abrasive particles, such as sand, rock cuttings, and the like. Generally, steel body PDC bits are coated with a more erosion-resistant material, such as tungsten carbide, to improve their erosion resistance. However, tungsten carbide and other erosion-resistant materials are relatively brittle. During use, a thin coating of the erosion-resistant material may crack, peel off, or wear, exposing the softer steel body which is then rapidly eroded. This can lead to loss of PDC cutters as the area around the cutter is eroded away, causing the bit to fail.

Tungsten carbide or other hard metal matrix body bits have the advantage of higher wear and erosion resistance as compared to steel bit bodies. The matrix bit generally is formed by packing a graphite mold with tungsten carbide powder and then infiltrating the powder with a molten copper-based alloy binder. There are several types of tungsten carbide that have been used in forming matrix bodies, including macrocrystalline tungsten carbide, cast tungsten carbide, carburized (or agglomerated) tungsten carbide, and cemented tungsten carbide. The tungsten carbide may be in the form of angular or spherical particles. Macrocrystalline tungsten carbide is essentially stoichiometric WC which is, for the most part, in the form of single crystals; however, some large crystals of macro-crystalline WC are bi-crystals. Carburized tungsten carbide has a multi-crystalline structure, i.e., they are composed of WC agglomerates.

Cast tungsten carbide, on the other hand, is formed by melting tungsten metal (W) and tungsten monocarbide (WC) together such that a eutectic composition of WC and $W_2C$, or a continuous range of compositions therebetween, is formed. Cast tungsten carbide typically is frozen from the molten state and comminuted to a desired particle size. The last type of tungsten carbide, which has been typically used in hardfacing, is cemented tungsten carbide, also known as sintered tungsten carbide. Sintered tungsten carbide comprises small particles of tungsten carbide (e.g., 1 to 15 microns) bonded together with cobalt. Sintered tungsten carbide is made by mixing organic wax, tungsten carbide and cobalt powders, pressing the mixed powders to form a green compact, and "sintering" the composite at temperatures near the melting point of cobalt. The resulting dense sintered carbide can then be crushed and comminuted to form particles of sintered tungsten carbide for use in hardfacing.

Bit bodies formed from either cast or macrocrystalline tungsten carbide or other hard metal matrix materials, while more erosion resistant than steel, lack toughness and strength, thus making them brittle and prone to cracking when subjected to impact and fatigue forces encountered during drilling. This can result in cracks in the bit body and/or eventually one or more blades breaking off the bit causing a catastrophic premature bit failure. The formation and propagation of cracks in the matrix body may result in the loss of one or more PDC cutters. A lost cutter may abrade against the bit, causing further accelerated bit damage. However, bits formed with sintered tungsten carbide may have sufficient toughness and strength for a particular application, but may lack other mechanical properties, such as erosion resistance. Thus, previous efforts have instead relied on combinations of materials to achieve a balance of properties.

Accordingly, there exists a need for a new matrix body composition for drill bits which has high strength and toughness, resulting in improved ability to reduce cracks in blades and to retain cutters, while maintaining other desired properties such as wear and erosion resistance.

SUMMARY OF INVENTION

In one aspect, embodiments disclosed herein relate to a drill bit that includes a bit body having a plurality of blades extending radially therefrom, at least a portion of the plurality of blades comprises a first matrix region comprising a plurality of first carbide particles separated by a first binder phase, each of the first carbide particles comprising a mixture of WC and $W_2C$, and wherein the first matrix region has less than about 5 percent by volume, based on the total volume of first matrix region, of complex metal carbides dispersed in the first binder phase; and at least one cutting element for engaging a formation disposed on at least one of the plurality of blades.

In another aspect, embodiments disclosed herein relate to a drill bit that includes a bit body having a plurality of blades extending radially therefrom, at least a portion of the plurality of blades comprises a first matrix region comprising a plurality of first carbide particles separated by a first binder phase, each of the first carbide particles comprising a core of a mixture of WC and $W_2C$ and a shell of WC; and at least one cutting element for engaging a formation disposed on at least one of the plurality of blades.

In another aspect, embodiments disclosed herein relate to a drill bit that includes a bit body having a plurality of blades extending radially therefrom, at least a portion of the plurality of blades comprises a first matrix region comprising a plurality of first carbide particles separated by a first binder phase, each of the first carbide particles comprising a core of a mixture of WC and $W_2C$ and a shell of WC, and the first carbide particles having an average particle size of at least about 100 microns; and at least one cutting element for engaging a formation disposed on at least one of the plurality of blades.

In yet another aspect, embodiments disclosed herein relate to a method of forming a matrix bit body, that includes loading a first matrix powder comprising a plurality of first carbide particles into a mold cavity, the plurality of first carbide particles comprising a core of a mixture of WC and $W_2C$ and a shell of WC; and heating and infiltrating the mold contents with an infiltration binder.

In yet another aspect, embodiments disclosed herein relate to a method of forming a matrix bit body, that includes loading a first matrix powder comprising a plurality of first carbide particles into a mold cavity, each of the first carbide particles comprising a mixture of WC and $W_2C$; heating the first matrix powder in the presence of a source of carbon; and heating and infiltrating the mold contents with an infiltration binder.

In yet another aspect, embodiments disclosed herein relate to a method of forming a matrix bit body that includes loading a first matrix powder comprising a plurality of first carbide particles into a mold cavity having at least a portion of its inner surface comprising a carbon source, each of the first carbide particles comprising a mixture of $W_2C$ and WC; and heating and infiltrating the mold contents with an infiltration binder.

In yet another aspect, embodiments disclosed herein relate to a method of forming a matrix bit body that includes loading a first matrix powder comprising a plurality of first carbide particles and a carbon source into a mold cavity, each of the first carbide particles comprising a mixture of $W_2C$ and WC; and heating and infiltrating the mold contents with an infiltration binder.

Other aspects and advantages of the invention will be apparent from the following description and the appended claims.

DETAILED DESCRIPTION

Figure 1A:
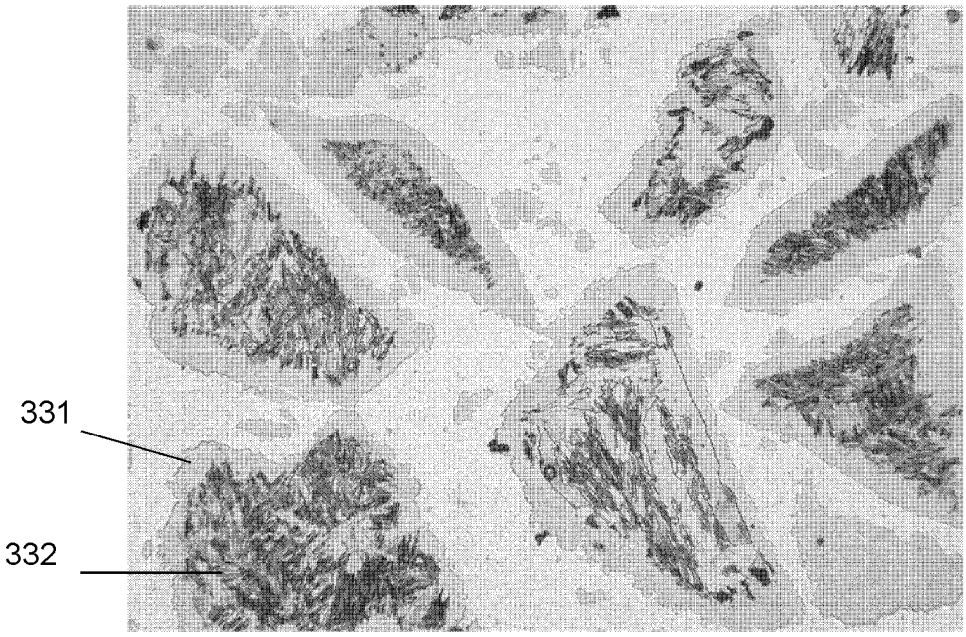
FIG. 1A is a scanning electron microscope image of one embodiment according to the present disclosure.

Embodiments of the present disclosure provide for matrix bodies formed from tungsten carbide particles. In particular, embodiments of the present disclosure provide matrix bodies formed from such carbide powders infiltrated by suitable metals or alloys as infiltration binders. Such a matrix body has high strength and toughness while maintaining desired braze strength, wear, and erosion resistance.

In particular, while conventional approaches to balancing wear/erosion resistance with toughness/strength rely on a combination of carbide particle types, with limited cast carbide quantities of less than 30 percent (due to its brittleness), the present disclosure is instead directed to use of surface reacted cast tungsten carbide to gain the hardness benefit of the cast carbide while minimizing the conventional drawbacks associated therewith.

In a bit body, the tungsten carbide particles may be surrounded by a metallic binder. The metallic binder may be formed from a metallic binder powder and an infiltration binder. The metallic binder powder may be pre-blended with the matrix powder hard carbide particles. To manufacture a bit body, matrix powder is infiltrated by an infiltration binder. The term "infiltration binder" herein refers to a metal or an alloy used in an infiltration process to bond the various particles of tungsten carbide together. Thus, embodiments of the present disclosure relate to the types of carbide particles used in the matrix powder (cast carbides, in particular), the conditions to which those particles are exposed during the manufacture process, and/or the properties of the resulting continuous binder phase.

Cast tungsten carbide is a eutectic mixture of bitungsten carbide ($W_2C$) and monotungsten carbide (WC). Cast carbide is typically made by resistance heating tungsten in contact with carbon, and may include angular and spherical particles. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. Thus, for example, the cast tungsten carbide used in the mixture of tungsten carbides may be comprised of from about 3.7 to about 4.2 weight percent carbon.

The presence of $W_2C$ in cast carbide is generally considered to reduce the toughness of a sintered product (cast carbide with a metal) in two aspects: $W_2C$ is more brittle than WC; and $W_2C$ is less stable than WC, causing a potential dissolution of $W_2C$ in molten metal (during the infiltration process) and subsequent reaction/precipitation (during cooling) as a complex metal carbide (e.g., $(W,Co)_6C$), often referred to as an eta phase, that is also very brittle. In addition to these eta phase particles being brittle, they may also reduce the mean free path between particles, which also reduces the overall toughness. However, by using cast carbide particles having an outer surface thereof reacted to have a WC (without $W_2C$) shell surrounding a core of WC/$W_2C$ mixture in at least a portion of the matrix bit body (preferably an exterior surface thereof), the benefits of cast carbides may be realized while minimizing the negative impact on the matrix body's toughness. By incorporating the surface reacted cast carbides at an exterior surface of the bit, the toughness may be optimized at least at the region where cracks may initiate (and begin to propagate) while providing hard, wear and erosion resistance properties as well.

Figure 1B:
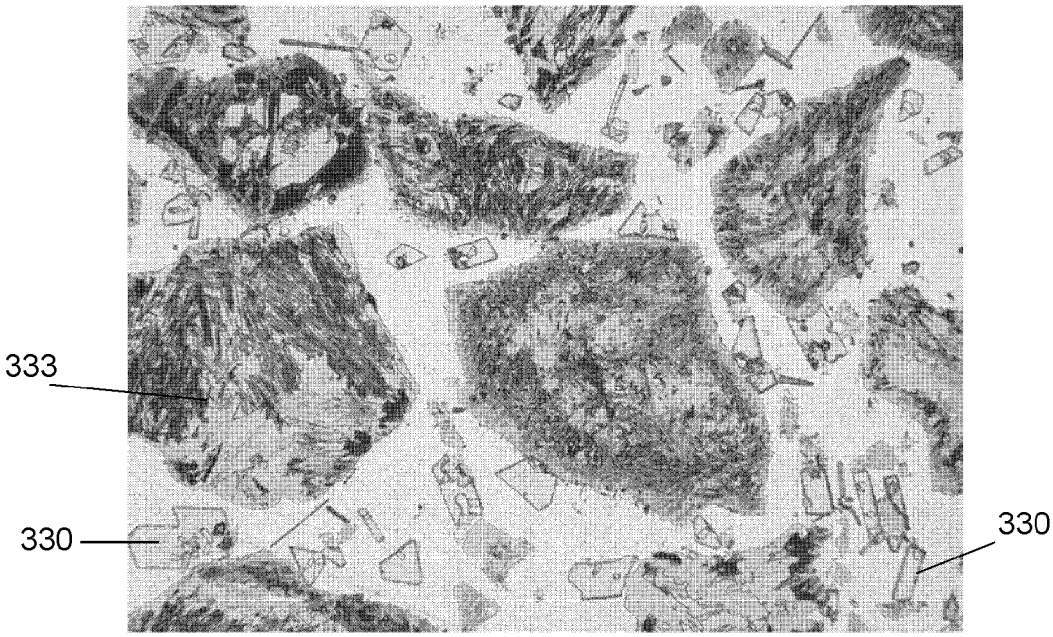
FIG. 1B Prior Art
FIG. 1B is a scanning electron microscope image of a prior art matrix material.

Surface reacted cast carbide particles, i.e., particles having a core of a WC and $W_2C$ mixture surrounded by a shell of WC, may be formed by exposing a conventional cast carbide particle (being a mixture of $W_2C$ and WC) to a carbon source in the presence of elevated temperatures such that the carbon reacts with the relatively instable $W_2C$ present along the outer surface of the particle to form the more stable WC. The WC shell, being relatively more stable than $W_2C$, is not readily dissolved by molten metal during a bit infiltration, thus preventing or at least reducing the amount of eta phase precipitation of complex metal carbides. Thus, when using surface reacted cast carbides in a matrix powder, the amount of eta phase impurities in the resulting metal continuous phase may be reduced. In particular, according to some embodiments, the metallic phase surrounding the surface-reacted carbide particles may contain less than about 5% by volume of complex metal carbide precipitants (estimated from an area percent from an SEM, for example), based on the total volume of matrix, less than about 3% by volume of complex metal carbide precipitants, less than about 1.5% by volume of complex metal carbide precipitants, and may be substantially free (less than 1% v) of complex metal carbide precipitants. The increase in purity of the metallic phase may allow for an optimization of its toughness (without or with less dilution by the impurities). FIGS. 1A and 1B show scanning electron microscope (SEM) images of an embodiment of the present disclosure (FIG. 1A) compared to a prior art matrix body (FIG. 1B). From the figures, the reduction (and in fact absence) of eta phase particles 330 from the SEM of the embodiment of the present disclosure is evident in comparison to the prior art SEM. Additionally, the presence of a WC shell 331 surrounding the flaky or feature like $W_2$. C/WC mixture core 332 is evident, in comparison to the prior art $W_2C$/WC particles 333.

The thickness of the shell (extent of reacted $W_2C$) may vary depending on the temperatures used and the length of exposure time. Surface-reacted cast carbide particles may form the matrix powder composition (pre-reacted) or the surface reaction may occur in situ, during the bit processing, after the powder has been loaded into a mold. One commercial example of such a pre-reacted particle type is AMPERWELD® Macroline Tungsten Carbide, sold by H.C. Starck Inc. (Conroe, Tex.).

Figure 2:
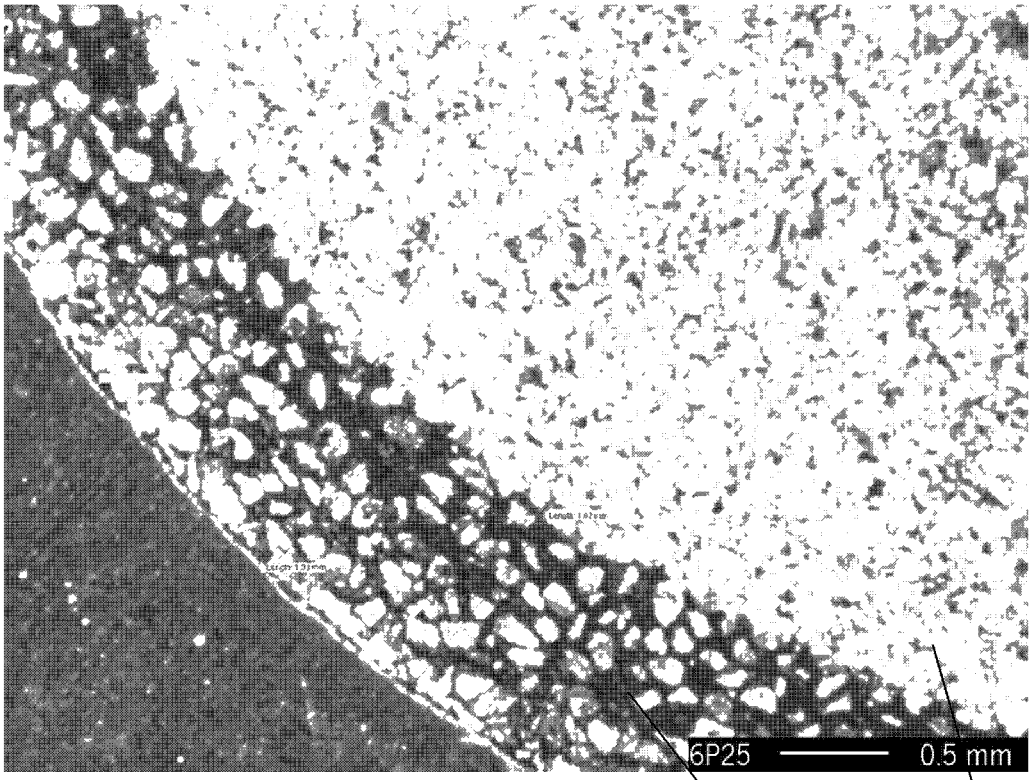
FIG. 2 is a scanning electron microscope image of one embodiment according to the present disclosure.

In addition to use of pre-reacted carbides, the surface reaction may alternatively occur during the general bit manufacture conditions, i.e. in situ, and any cast carbide type may be used. In particular, the surface reaction may occur during the bit manufacturing process by loading of cast carbide powder in a mold containing a carbon source on at least a portion of an inner surface thereof. For example, the mold may be a graphite mold (i.e., carbon source), as known in the art, but without a mold release agent or coating that is conventionally provided on the inner surface between the graphite and carbide powder to aid in removal of the mold after manufacture. Alternatively, a composite mold having graphite contained therein, or any mold having a graphite layer (or other carbon source) placed on at least one inner mold surface may be used. Following loading of cast carbide particles (and other matrix powders) into the mold, the mold is preheated, and ramped up to the infiltration temperature so that infiltration binder blocks placed on top of the matrix powder may melt and infiltrate through the matrix powder. During the pre-heating and ramp-up (prior to the infiltration of the infiltration binder), the carbon from the mold may diffuse into a layer of the matrix powder and react with the relatively instable $W_2C$ present along the outer surface of the cast carbide particles to form the more stable WC shell surrounding the WC/$W_2C$ core. Then, upon reaching the melting temperature of the infiltration binder, the molten metal may infiltrate the cast carbide particles, and the presence of the stable WC shell around the WC/$W_2C$ mixture may reduce or minimize the dissolution of any $W_2C$ into the molten metal and thus reduce or minimize the reaction/precipitation of complex metal carbides during cooling of the bit. The extent of the diffusion of carbon into the mold contents (i.e., the matrix powder) may depend on the ramp-up rate. Thus, as shown in FIG. 2, which is a scanning electron microscope (SEM) image of a matrix body sample of cast carbide particles infiltrated with an infiltration binder that was prepared in a graphite mold that did not have a mold release agent contained thereon. As seen in FIG. 2, there is a layer 240 of the resulting sample that has the appearance of a darker binder phase. This darkness is representative of a very shiny (and relatively pure) metal phase, as compared to the inner region 241 of the sample, which has the appearance of a lighter binder phase, indicative of the presence of a high level of eta phase particles distributed through the binder phase. As mentioned above, the thickness of this "pure" layer depends on the extent to which carbon diffuses into the matrix powder, which in turn depends on the heating conditions such as temperatures, ramp rates, etc. In yet another alternative, if a uniform reduction of eta phase particles throughout the entire cast carbide matrix powder region is desired, a carbon source (component) such as carbon black or graphite particles may be added to the matrix powder, so that the total carbon content (cast carbide and carbon source) is at least greater than 4.2 percent by weight (% w), and preferably between 4.3% w and 6% w (of the combined weight of cast carbide particles and carbon source). The amount of carbon black (as a percent of the matrix powder) may vary based on the relative amounts of non-cast carbide particles in the matrix powder. The carbon source mixed in the matrix powder would then react during bit pre-heating and ramp-up with the $W_2C$ present along the outer surface of the cast carbide particles to form the more stable WC shell surrounding the WC/$W_2C$ core in a similar manner as that described above.

In preferred embodiments (for surface reacted cast carbides formed in situ), the mold contents (i.e., matrix powder) may be heated under conditions (e.g., from room temperature to a pre-heat temperature) sufficient to form a layer of WC on at least a portion of the surface of at least a portion of the cast carbide particles (WC/$W_2C$), and then may be further heated under conditions (e.g., from the pre-heat temperature to the final infiltration temperature) sufficient to allow the infiltration binder to infiltrate the mold contents. One example of a suitable heating schedule is shown below in Table 1:

TABLE 1

| Step | Range | Ramp Rate (° C./min) |
|---|---|---|
| Preheat | R.T. to ~540° C. | 10-30 |
| Preheat | ~540° C. to ~650° C. | 5-11 |
| Preheat | Hold time varies per bit size | Hold |
| Infiltration | ~650° C. to ~1095° C. | 2-8 |
| Infiltration | ~1095° C. to 1205° C. | 1-5 |
| Infiltration | Hold time varies per bit size | |

Additionally, one skilled in the art would appreciate that the some of these temperature ranges may depend, for example, on type of alloy being used.

The carbides particles discussed above may be used in a variety of particle sizes. For example, in a particular embodiment, the matrix powder may have a mean particle size ranging from about 50 to about 840 microns, and from 100 to 500 microns in a particular embodiment. Further, carbide particles are often measured in a range of mesh sizes, for example −40+80 mesh. The term "mesh" actually refers to the size of the wire mesh used to screen the carbide particles. For example, "40 mesh" indicates a wire mesh screen with forty holes per linear inch, where the holes are defined by the crisscrossing strands of wire in the mesh. The hole size is determined by the number of meshes per inch and the wire size. The mesh sizes referred to herein are standard U.S. mesh sizes. For example, a standard 40 mesh screen has holes such that only particles having a dimension less than 420 μm can pass. Particles having a size larger than 420 μm are retained on a 40 mesh screen and particles smaller than 420 μm pass through the screen. Therefore, the range of sizes of the carbide particles is defined by the largest and smallest grade of mesh used to screen the particles. Carbide particles in the range of −16+40 mesh (i.e., particles are smaller than the 16 mesh screen but larger than the 40 mesh screen) will only contain particles larger than 420 μm and smaller than 1190 μm, whereas particles in the range of −40+80 mesh will only contain particles larger than 180 μm and smaller than 420 μm. Thus, use of mesh screening may allow for an easy determination of particle size distribution.

Particle size distribution may be expressed as being with a certain sigma from a median particle size. In one embodiment, a relatively uniform sized matrix powder may be used, such as that disclosed in U.S. Patent Publication No. 2009/0260893A1, which is assigned to the present assignee and herein incorporated by reference in its entirety. For example, in a particular embodiment, the particle size distribution of the matrix powder may be within ±20%, and ±15% in another embodiment, of the median particle size. Alternatively, the matrix powder may have 90% of the carbide particles within 20% of a median particle size, and within 15% or 10% of the median particle size in other embodiments. In yet another embodiment, the matrix powder may have 95% of the carbide particles within 20% of a median particle size, and within 15% or 10% of the median particle size in yet other embodiments. Thus, exemplary mesh sizes may include −230+325, −200+270, −170+230, −140+200, −120+170, −100+140, −80+120, −70+100, −60+80, −50+70, and −35+45. Further, one skilled in the art would appreciate that uniformly sized matrix powder may be taken from either end of the size spectrum, including fine or coarse particles. However, in a particular embodiment, the coarser, rather than finer, particles may be used, with the average particle size ranging between about 100 and 500 microns, and between about 150 and 400 microns in another particular embodiment.

Further, one skilled in the art would appreciate that wear/toughness properties may be altered by incorporation of other tungsten carbide types (with the cast carbide particles). Moreover, among the types of tungsten carbide, some types are known as being more wear resistant than others, while the others may have greater contribution to toughness.

As discussed above, one type of tungsten carbide is macrocrystalline carbide. This material is essentially stoichiometric WC in the form of single crystals. Most of the macrocrystalline tungsten carbide is in the form of single crystals, but some bicrystals of WC may form in larger particles. The manufacture of macrocrystalline tungsten carbide is disclosed, for example, in U.S. Pat. Nos. 3,379,503 and 4,834,963, which are herein incorporated by reference.

U.S. Pat. No. 6,287,360, which is assigned to the assignee of the present invention and is herein incorporated by reference, discusses the manufacture of carburized tungsten carbide. Carburized tungsten carbide, as known in the art, is a product of the solid-state diffusion of carbon into tungsten metal at high temperatures in a protective atmosphere. Carburized tungsten carbide grains are typically multi-crystalline, i.e., they are composed of WC agglomerates. The agglomerates form grains that are larger than individual WC crystals. These larger grains make it possible for a metal infiltrant or an infiltration binder to infiltrate a powder of such large grains. On the other hand, fine grain powders, e.g., grains less than 5 μm, do not infiltrate satisfactorily. Typical carburized tungsten carbide contains a minimum of 99.8% by weight of carbon infiltrated WC, with a total carbon content in the range of about 6.08% to about 6.18% by weight. Tungsten carbide grains designated as WC MAS 2000 and 3000-5000, commercially available from H. C. Stark, are carburized tungsten carbides suitable for use in the formation of the matrix bit body disclosed herein. The MAS 2000 and 3000-5000 carbides have an average size of 20 and 30-50 micrometers, respectively, and are coarse grain conglomerates formed as a result of the extreme high temperatures used during the carburization process.

Another form of tungsten carbide is cemented tungsten carbide (also known as sintered tungsten carbide), which is a material formed by mixing particles of tungsten carbide, typically monotungsten carbide, and cobalt particles, and sintering the mixture. Methods of manufacturing cemented tungsten carbide are disclosed, for example, in U.S. Pat. Nos. 5,541,006 and 6,908,688, which are herein incorporated by reference. Sintered tungsten carbide particles are commercially available in two basic forms: crushed (or angular) and spherical (or pelletized). Crushed sintered tungsten carbide is produced by crushing sintered components into finer particles, resulting in more irregular and angular shapes, whereas pelletized sintered tungsten carbide is generally rounded or spherical in shape.

Briefly, in a typical process for making cemented tungsten carbide, a tungsten carbide powder having a predetermined size (or within a selected size range) is mixed with a suitable quantity of cobalt, nickel, or other suitable binder. The mixture is typically prepared for sintering by either of two techniques: it may be pressed into solid bodies often referred to as green compacts, or alternatively, the mixture may be formed into granules or pellets such as by pressing through a screen, or tumbling and then screened to obtain more or less uniform pellet size. Such green compacts or pellets are then heated in a controlled atmosphere furnace to a temperature near the melting point of cobalt (or the like) to cause the tungsten carbide particles to be bonded together by the metallic phase. Sintering globules of tungsten carbide specifically yields spherical sintered tungsten carbide. Crushed cemented tungsten carbide may further be formed from the compact bodies or by crushing sintered pellets or by forming irregular shaped solid bodies.

The particle size and quality of the sintered tungsten carbide can be tailored by varying the initial particle size of tungsten carbide and cobalt, controlling the pellet size, adjusting the sintering time and temperature, and/or repeated crushing larger cemented carbides into smaller pieces until a desired size is obtained. In one embodiment, tungsten carbide particles (unsintered) having an average particle size of between about 0.2 μm to about 20 μm are sintered with cobalt to form either spherical or crushed cemented tungsten carbide. In a preferred embodiment, the cemented tungsten carbide is formed from tungsten carbide particles having an average particle size of about 0.8 μm to about 5 μm. In some embodiments, the amount of cobalt present in the cemented tungsten carbide is such that the cemented carbide is comprised of from about 6 to 8 weight percent cobalt.

Thus, one skilled in the art would appreciate that in addition to the cast carbide particles disclosed herein, other tungsten carbides types (in any of the size ranges discussed above with respect to the cast carbides of the present disclosure) disclosed herein may also be used so as to provide a bit that is tailored for a particular drilling application. For example, the type (e.g., cast, cemented, or macrocrystalline tungsten carbide), shape, and/or size of carbide particles used in the formation of a matrix bit body may affect the material properties of the formed bit body, including, for example, fracture toughness, transverse rupture strength, and wear and erosion resistance.

As discussed above, there are several metals used in the manufacture of a bit body: a metal powder mixed with the carbide powder, and an infiltration binder. With respect to the infiltration binder, suitable metals include all transition metals, main group metals and alloys thereof. For example, copper, nickel, iron, and cobalt may be used as the major constituents in the infiltration binder. Other elements, such as aluminum, manganese, chromium, zinc, tin, silicon, silver, boron, and lead, may also be present in the infiltration binder. In one preferred embodiment, the infiltration binder is selected from at least one of nickel, copper, and alloys thereof. In another preferred embodiment, the infiltration binder includes a Cu—Mn—Ni—Zn alloy.

In one embodiment, nickel and/or iron powder may be present as the balance of the matrix powder (other than the carbide powder), in an amount ranging from about 6% to 16% by weight. In a particular embodiment, nickel and/or iron powder may form about 8 to 12% by weight of the matrix powder. However, one skilled in the art would appreciate that in addition to nickel and/or iron, other Group VIIIB metals such as cobalt and various alloys may also be used. Metal addition in the range of about 8% to about 12% may yield higher matrix strength and toughness, as well as higher braze strength.

By using matrix powders of the present disclosure, once infiltrated to form a matrix body (or region), the final binder (infiltrant and powder) content of the matrix region may range from about 35 to 55 percent by volume. In another embodiment, the final binder content may range from about 40 to 50 percent by volume. An alternative way of expressing the binder content may be by looking at the area fraction, which, may be estimated, for example, from SEMS of a resulting matrix body. Further, with a sufficient number of cross-sections, one skilled in the art would appreciate that the volume fraction may be estimated from the area fraction.

Further, while reference is made to tungsten carbide, one skilled in the art would appreciate that other carbides of Group 4a, 5a, or 6a metals may also be used. Further, one skilled in the art would also appreciate that the total carbide content may be at least 80%, preferably 85% or 90% by weight of the matrix powder prior to infiltration, such matrix bodies with lower carbide contents may not possess the desired physical properties to yield optimal performance.

The matrix body material in accordance with embodiments of the invention has many applications. Generally, the matrix body material may be used to fabricate the body for any earth-boring bit which holds a cutter or a cutting element in place. Earth-boring bits that may be formed from the matrix bodies disclosed herein include PDC drag bits, diamond coring bits, impregnated diamond bits, etc. These earth-boring bits may be used to drill a wellbore by contacting the bits with an earthen formation.

Figure 3A:
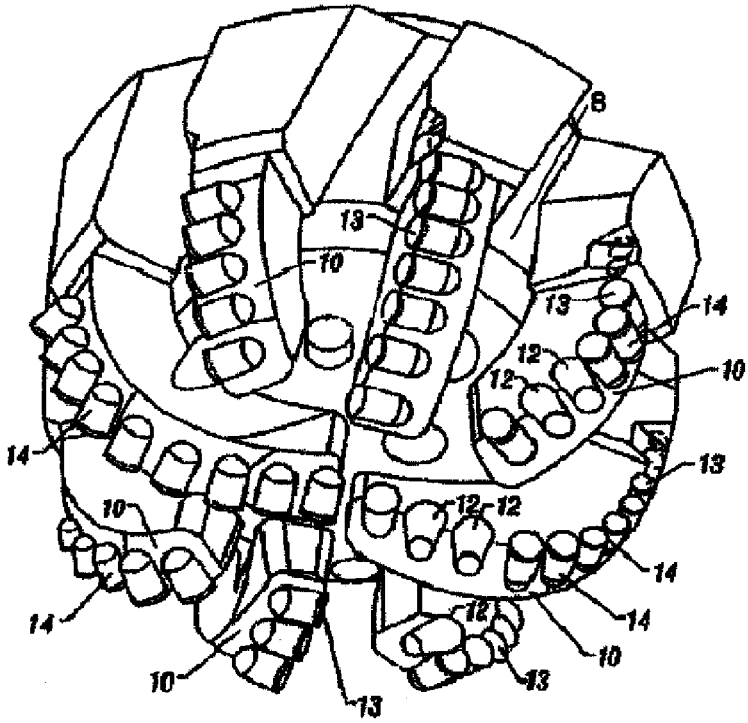
FIG. 3A is a perspective view of an earth boring PDC drill bit body with a plurality of cutters disposed thereon according to an embodiment.
Figure 3B:
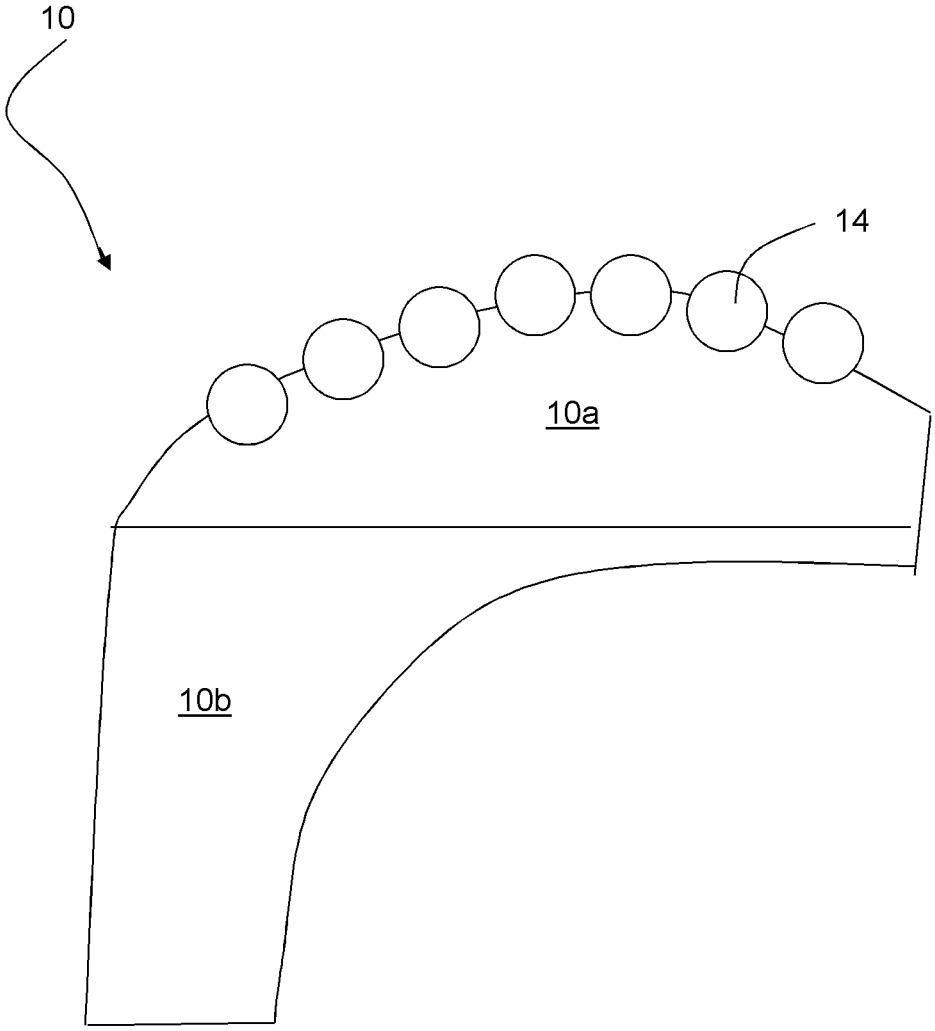
FIG. 3B shows a cross-sectional view of a blade in accordance with one embodiment.

A PDC drag bit body manufactured according to one embodiment of the present disclosure is illustrated in FIGS. 3A-B. Referring to FIG. 3A, a PDC drag bit body 8 is formed with blades 10 at its lower end. A plurality of recesses or pockets 12 are formed in the faces to receive a plurality of conventional polycrystalline diamond compact cutters 14. The PDC cutters, typically cylindrical in shape, are made from a hard material such as tungsten carbide and have a polycrystalline diamond layer covering the cutting face 13. The PDC cutters are brazed into the pockets after the bit body has been made.

Methods of making matrix bit bodies are known in the art and are disclosed for example in U.S. Pat. No. 6,287,360, which is assigned to the assignee of the present invention. These patents are hereby incorporated by reference. Briefly, infiltration processes that may be used to form a matrix bit body of the present disclosure may begin with the fabrication of a mold, having the desired body shape and component configuration. Matrix powder having cast carbides (pre-reacted or not) may be loaded into the mold (with a carbon source if not pre-reacted) in the desired location, i.e., blades, and the mass of particles may be infiltrated with a molten infiltration binder and cooled to form a bit body. Alternatively, a second matrix powder may be loaded onto the matrix powder (having the cast carbide particles as described above), such that a bit body (or blade, as shown in FIG. 3B) may be generally divided into two matrix regions: a first matrix region 10*a* formed from the cast carbides of the present disclosure and a second matrix region 10*b* formed from particles of non-limited type. In the embodiment shown, the first matrix region 10*a* forms a portion of the outer cutting portion of the blade, whereas the second matrix region 10*b* is layered thereon to form a portion of the base (and gage) of the blade. Further, there is no limitation on the number of or manner in which the layers may be provided in forming the bit.

Further, there is no limitation on the type of second matrix powder that may be used in combination with the cast carbide matrix powder of the present disclosure. For example, while such powder may optionally also include cast carbides, it is also within the scope of the present disclosure that such a second powder may be without cast carbides. Further, one skilled in the art would also appreciate that any of the carbide types described above may be used in such second matrix powder for forming a second matrix region.

While reference to a particular type of bit may have been made, no limitation on the present invention was intended by such description. Rather, the matrix bodies disclosed herein may specifically find use in PDC drag bits, diamond coring bits, impregnated diamond bits, etc. Thus, it is also within the scope of the present disclosure that at least one cutting element on a diamond impregnated drill bit may include, for example, at least one diamond impregnated insert. Further, any reference to any particular type of cutting element is also not intended to be a limitation on the present invention.

EXAMPLES

Figure 4:
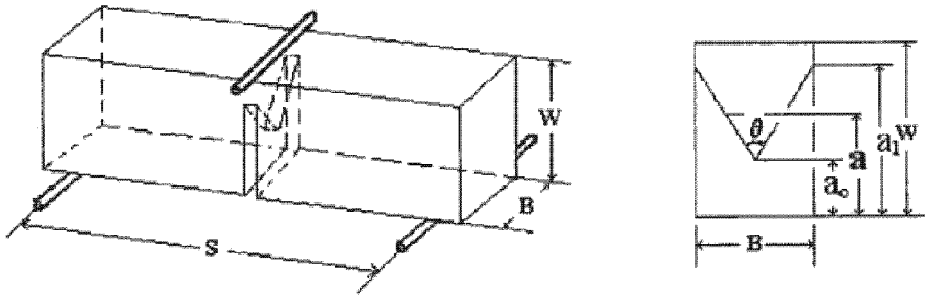
FIG. 4 a chevron-notched bar for determining fracture toughness.

Matrix powders having various carbides were infiltrated to test for various material properties, including transverse rupture strength (TRS), toughness, wear, and erosion resistance. Fracture toughness was measured as $K_{Ivb}$ (generally indicated as $K_{IC}$) in accordance with the ASTM C1421 chevron-notched beam test method. For this test, $$K_{Ic} = \frac{P\max}{B\sqrt{W}} Y_C(\alpha_0, \alpha_1)$$

wherein $P_{max}$ is the maximum load, B is the thickness of the specimen, W is the height, and $Y_C$ is a coefficient based on geometric factors, defined as the minimum stress-intensity factor coefficient. When the crack length $\alpha$ increases to a critical value $\alpha_C$, $Y(\alpha_0,\alpha_1,\alpha)$ reaches a minimum $Y_C(\alpha_0,\alpha_1)=Y(\alpha_0,\alpha_1,\alpha_C)$, and at the same time, the load P reaches a maximum $P_{max}$. FIG. 4 shows the geometry of a standard chevron-notched test specimen and the parameters used to calculate $Y_C$. Table 2 shows the $Y_C$ value for geometry parameters S=32, W=8, B=4, and $\theta$=55°, for Poison ratios of 0.25 and 0.3 that may be used to calculate $K_{IC}$.

TABLE 2

| $\alpha_0$ | $Y_C$ with Poison ratio 0.25 | $Y_C$ with Poison ratio 0.3 |
|---|---|---|
| 0.3 | 14.5145 | 14.51084 |
| 0.31 | 15.04254 | 15.03891 |
| 0.32 | 15.59683 | 15.59324 |
| 0.33 | 16.17944 | 16.17588 |
| 0.34 | 16.79259 | 16.78908 |
| 0.35 | 17.43874 | 17.43527 |
| 0.36 | 18.12053 | 18.11711 |
| 0.37 | 18.84087 | 18.8375 |
| 0.38 | 19.60293 | 19.59961 |
| 0.39 | 20.41016 | 20.4069 |
| 0.4 | 21.26637 | 21.26317 |

Tests for erosion resistance were conducted using a full-size in-house mud pump to simulate and evaluate mud erosion of a bit material or hardfacing at BHA condition. A pool of drilling mud was stored in mud tanks and compressed by a mud pump that is driven by a diesel motor. The mud is injected into twin nozzles (standard 16⁄32") at a velocity of about 107 m/s in each nozzle. A test sample and a reference sample are clamped onto a base plate such that the surface of each sample is perpendicular to the nozzles and spaced at about 2.54 cm apart. The mud used is a 10 lb water-based mud with 2% sand content (F-110 available from U.S. Silica Company, Berkeley Springs, W. Va.). Both samples are subjected to mud erosion for a constant duration of time (usually 30 minutes or 60 minutes) and the resultant wear scar is measured. The size of the wear scar is indicative of the susceptibility of the test sample to erosive wear. The wear resistance of the test sample is normalized against the wear resistance of the reference sample.

In order to improve selected mechanical properties of a matrix bit body, various mixtures of tungsten carbide particles were used to form a matrix body, and their mechanical properties were tested. The compositions include various ratios of, agglomerated or carburized tungsten carbide, cast tungsten carbide (non-surface reacted and without a carbon source in the mold) and surface-reacted cast carbide (AMPERWELD® Macroline Tungsten Carbide from H.C. Starck Inc.), and macrocrystalline tungsten carbide with a nickel and/or iron binder. The compositions tested are shown below in Table 3.

The compositions shown in Table 3 were tested for fracture toughness, wear number, transverse rupture strength, and erosion resistance in accordance with the tests detailed above.

Figure 5:
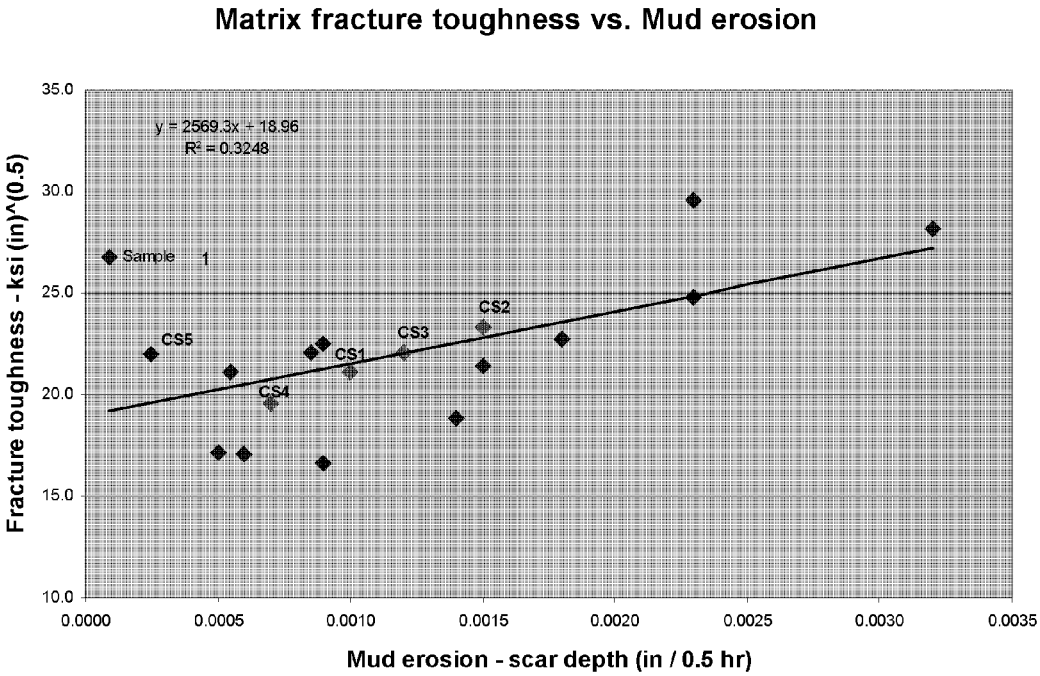
FIG. 5 shows a graphical comparison of fracture toughness versus erosion resistance for various matrix materials.

FIG. 5 shows the relationship between fracture toughness and erosion rate for the various compositions. In addition to those compositions listed in Table 3, several additional data points of various experimental matrix powders previously investigated by the inventor of the present disclosure are included to help indicate the general trend/relationship between toughness and erosion resistance for prior carbide matrix samples. As shown from FIG. 5, Sample 1, a matrix powder in accordance with the present disclosure, shows a significant improvement in toughness for the achieved erosion resistance (and vice versa). In particular, for properties which are generally considered to be inversely related (an improvement in one results in a sacrifice of the other), embodiments of the present disclosure may allow for increase in both properties simultaneously.

In particular, the matrix bodies made according to the embodiments of the present disclosure may have: a $K_{1C}$ (toughness) of greater than or equal to 25 ksi(in)$^{1/2}$, a transverse rupture strength of greater than or equal to 110 ksi, a mud erosion rate of less than or equal to 0.0003 in/hr, a carbide volume percent of greater than or equal to 53 percent (balance metal), and an eta-phase (or other reactionary products) in the metal phase of less than 5 percent by volume (% v), based on the total volume of the matrix, in some embodiments, less than 3% v in other embodiments, and less than 1.5% v in yet other embodiments.

Advantages of the present invention may include one or more of the following. Using "typical" industry ingredients, a wall is reached for further improvement. Typically toughness and wear/erosion resistance are inversely related, so tradeoffs are made to achieve a certain balance. While cast carbide is known to provide high erosion resistance, the $W_2C$ contained therein causes impurities to be formed during the manufacture process, having a negative impact on toughness. According to the embodiments of the present disclosure, a matrix with good erosion properties may be used without eta-phase precipitants, keeping the metal phase purer and maximizing the natural toughness of the metal. Further, erosion resistance may be maximized by using coarser particles for an anchoring effect. Additionally, bits formed using the materials of the present disclosure may have high braze strength values. In particular, the reduction or absence) of complex metal carbides in the in the matrix region juxtaposed to the cutting elements (forming the cutter pockets) may provide for an improved braze strength (cutter retention) because the presence of these impurities in the matrix body may render the interface between the matrix body and braze similarly impure, resulting in a negative impact on the braze strength for a given alloy.

TABLE 3

| | Composition | | | | | |
|---|---|---|---|---|---|---|
| Sample | Surface Reacted Cast (%) (mesh) | Agg. WC (%) (mesh) | Cast (%) (mesh) | Macro (%) (mesh) | Ni (%) | Fe (%) |
| Comparative 1 | — | — | 33 | 65 | — | 2 |
| Comparative 2 | — | 62 | 30 | — | 8 | — |
| Comparative 3 | — | 56 | 35 | — | 8 | 1 |
| Comparative 4 | — | 46 | 50 | — | 2 | 2 |
| Comparative 5 | — | — | 92 (−80 + 120) | — | 8 | — |
| Sample 1 | 92 (−80 + 120) | — | | — | 8 | — |

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A drill bit, comprising:

a bit body having a plurality of blades extending radially therefrom, at least a portion of the plurality of blades comprises a first matrix region comprising:

a plurality of first carbide particles separated by a first binder phase, each of the first carbide particles comprising a mixture of monotungsten carbide and bitungsten carbide, wherein the first carbide particles comprise angular particles; and wherein the first matrix region has less than about 5 percent by volume, based on the total volume of the first matrix region, of complex metal carbides dispersed in the first binder phase;

wherein the first binder phase comprises from about 35 to 55 percent by volume of the first matrix region; and at least one cutting element for engaging a formation disposed on at least one of the plurality of blades wherein the first matrix region has a fracture toughness, $K_{1C}$, of greater than or equal to 25 ksi(in)$^{1/2}$, a transverse rupture strength of greater than or equal to 110 ksi, and a mud erosion rate of less than or equal to 0.0003 in/hr.

2. The drill bit of claim 1, wherein the first matrix region has less than about 3 percent by volume, based on the total volume of the first matrix region, of complex metal carbides disposed in the first binder phase.

3. The drill bit of claim 1, wherein the first matrix region has less than about 1.5 percent by volume, based on the total volume of the first matrix region, of complex metal carbides disposed in the first binder phase.

4. The drill bit of claim 1, wherein the first matrix region is substantially free of complex metal carbides disposed in the first binder phase.

5. The drill bit of claim 1, wherein the first carbide particles have a particle size distribution of ±20% or less of a median particle size.

6. The drill bit of claim 1, wherein the first matrix region further comprises at least one of cemented tungsten carbide, carburized tungsten carbide or macrocrystalline tungsten carbide.

7. The drill bit of claim 1, wherein at least a portion of the plurality of blades comprises a second matrix region comprising a plurality of second carbide particles separated by a second binder phase.

8. The drill bit of claim 7, wherein the plurality of second carbide particles comprise at least one of cemented tungsten carbide, cast tungsten carbide, macrocrystalline tungsten carbide, carburized tungsten carbide, or combinations thereof

9. The drill bit of claim 1, wherein the first matrix region is adjacent to the at least one cutting element.

10. The drill bit of claim 1, wherein each of the first carbide particles comprises a core of the mixture of monotungsten carbide and bitungsten carbide and a shell of monotungsten carbide.

11. The drill bit of claim 10, wherein a mean particle size of the first carbide particles ranges from 50 to 840 microns.

12. A drill bit, comprising:

a bit body having a plurality of blades extending radially therefrom, at least a portion of the plurality of blades comprises a first matrix region comprising a plurality of first carbide particles separated by a first binder phase, each of the first carbide particles comprising a mixture of monotungsten carbide and bitungsten carbide, wherein the first carbide particles comprise angular particles; and at least one cutting element for engaging a formation disposed on at least one of the plurality of blades;

wherein at least a second portion of the plurality of blades comprises a second matrix region comprising a plurality of second carbide particles separated by a second binder phase, wherein the first matrix region has a fracture toughness, $K_{1C}$, of greater than or equal to 25 ksi (in)$^{1/2}$, a transverse rupture strength of greater than or equal to 110 ksi, and a mud erosion rate of less than or equal to 0.0003 in/hr.

13. The drill bit of claim 12, wherein the first carbide particles have a particle size distribution of ±20% or less of a median particle size.

14. The drill bit of claim 12, wherein the first matrix region further comprises at least one of cemented tungsten carbide, carburized tungsten carbide or macrocrystalline tungsten carbide.

15. The drill bit of claim 12, wherein the first matrix region has less than about 5% by volume, based on the total volume of the first matrix region, of complex metal carbides dispersed in the first binder phase.

16. The drill bit of claim 12, wherein the first matrix region has less than about 1.5% by volume, based on the total volume of the first matrix region, of complex metal carbides dispersed in the first binder phase.

17. The drill bit of claim 12, wherein the plurality of second carbide particles comprise at least one of cemented tungsten carbide, cast tungsten carbide, macrocrystalline tungsten carbide, carburized tungsten carbide, or combinations thereof

18. The drill bit of claim 12, wherein the first matrix region is adjacent to the at least one cutting element.

19. The drill bit of claim 12, wherein each of the first carbide particles comprises a core of the mixture of monotungsten carbide and bitungsten carbide and a shell of monotungsten carbide.

20. The drill bit of claim 12, wherein the first carbide particles have an average particle size of at least about 100 microns.

* * * * *